US010655199B2

(12) United States Patent
Tanaka et al.

(10) Patent No.: US 10,655,199 B2
(45) **Date of Patent: *May 19, 2020**

(54) STEEL SHEET FOR CROWN CAP, METHOD FOR MANUFACTURING STEEL SHEET FOR CROWN CAP, AND CROWN CAP

(71) Applicant: JFE STEEL CORPORATION, Tokyo (JP)

(72) Inventors: Takumi Tanaka, Fukuyama (JP); Tomonari Hiraguchi, Fukuyama (JP); Katsumi Kojima, Fukuyama (JP); Hiroki Nakamaru, Chiba (JP); Nobusuke Kariya, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 210 days.

This patent is subject to a terminal disclaimer.

(21) Appl. No.: 15/551,641

(22) PCT Filed: Jan. 27, 2016

(86) PCT No.: PCT/JP2016/000391

§ 371 (c)(1),
(2) Date: Aug. 17, 2017

(87) PCT Pub. No.: WO2016/136140

PCT Pub. Date: Sep. 1, 2016

(65) Prior Publication Data

US 2018/0051362 A1 Feb. 22, 2018

(30) Foreign Application Priority Data

Feb. 26, 2015 (JP) ..... 2015-036400

(51) Int. Cl.

| | |
|---|---|
| ***C21D 9/46*** | (2006.01) |
| ***C22C 38/06*** | (2006.01) |
| ***C22C 38/00*** | (2006.01) |
| ***C21D 8/02*** | (2006.01) |
| ***C22C 38/02*** | (2006.01) |
| ***C22C 38/04*** | (2006.01) |
| *B65D 41/12* | (2006.01) |

(52) U.S. Cl.

CPC ..... *C22C 38/06* (2013.01); *C21D 8/0268* (2013.01); *C21D 9/46* (2013.01); *C22C 38/00* (2013.01); *C22C 38/001* (2013.01); *C22C 38/004* (2013.01); *C22C 38/02* (2013.01); *C22C 38/04* (2013.01); *B65D 41/12* (2013.01)

(58) Field of Classification Search

CPC ..... B65D 41/12; C21D 8/0268; C21D 9/46; C22C 38/00

USPC ..... 148/330

See application file for complete search history.

(56) References Cited

U.S. PATENT DOCUMENTS

| | | | | |
|---|---|---|---|---|
| 6,217,680 | B1 | 4/2001 | Kawabata et al. | |
| 7,501,031 | B2 * | 3/2009 | Takeuchi | C22C 38/06 148/320 |
| 10,144,985 | B2 | 12/2018 | Saito et al. | |
| 10,184,159 | B2 * | 1/2019 | Holleck | C21D 8/0426 |
| 2009/0025838 | A1 | 1/2009 | Mineji et al. | |
| 2014/0034195 | A1 | 2/2014 | Suto et al. | |
| 2016/0010172 | A1 | 1/2016 | Holleck et al. | |
| 2017/0292176 | A1 * | 10/2017 | Tsujimoto | C21D 6/005 |

FOREIGN PATENT DOCUMENTS

| | | | |
|---|---|---|---|
| CN | 103597110 | A | 2/2014 |
| CN | 103649353 | A | 3/2014 |
| EP | 0 662 523 | A1 | 7/1995 |
| EP | 1 607 490 | A1 | 12/2005 |
| EP | 2468909 | A1 | 6/2012 |
| EP | 2 479 308 | A1 | 7/2012 |
| EP | 2 700 731 | A1 | 2/2014 |
| EP | 3 205 739 | A1 | 8/2017 |
| JP | H07-228921 | A | 8/1995 |
| JP | H08218146 | A | 8/1996 |
| JP | H10-060542 | A | 3/1998 |
| JP | 2001-049383 | A | 2/2001 |
| JP | 2006028640 | A | 2/2006 |
| JP | 2007239036 | A | 9/2007 |
| JP | 2010180423 | A | 8/2010 |
| JP | 2013-028842 | A | 2/2013 |
| KR | 0179419 | B | 11/1998 |
| KR | 20120031509 | A | 4/2012 |

(Continued)

OTHER PUBLICATIONS

Aug. 23, 2016 Office Action issued in Taiwanese Patent Application No. 105104286.

Apr. 19, 2016 International Search Report issued in International Patent Application No. PCT/JP2016/000391.

May 31, 2018 Office Action issued in Chinese Patent Application No. 201680011415.6.

Oct. 31, 2018 Office Action issued in Korean Application No. 10-2017-7022820.

May 2, 2019 Office Action issued in Australian Application No. 2016225754.

Aug. 15, 2018 Office Action issued in Australian Application No. 2016225754.

(Continued)

*Primary Examiner* — Jie Yang

(74) *Attorney, Agent, or Firm* — Oliff PLC

(57) ABSTRACT

Provided are a steel sheet, having sufficient strength and formability regardless of reduction of thickness, for crown caps; a method for manufacturing the same; and a crown cap. The steel sheet for crown caps has a composition containing C: 0.0010% to less than 0.0050%, Si: 0.10% or less, Mn: 0.05% to less than 0.50%, P: 0.050% or less, S: 0.050% or less, Al: more than 0.002% to less than 0.070%, N: less than 0.0040%, and B: 0.0005% to 0.0020% on a mass basis, the balance being Fe and inevitable impurities, and also has a yield strength of 500 MPa or more in a rolling direction, an average Lankford value (r) of 1.1 or more, and an in-plane anisotropy (Δr) of Lankford value of −0.3 to 0.3.

8 Claims, No Drawings

(56) References Cited

FOREIGN PATENT DOCUMENTS

| | | | |
|---|---|---|---|
| KR | 2012-0062930 | A | 6/2012 |
| KR | 20170052660 | A | 5/2017 |
| WO | 2014/135645 | A2 | 9/2014 |
| WO | 2016/056239 | A1 | 4/2016 |

OTHER PUBLICATIONS

Aug. 29, 2018 Office Action issued in Canadian Application No. 2,975,068.
Jan. 2, 2019 Office Action issued in U.S. Appl. No. 15/121,540.
Jul. 4, 2019 Notice of Allowance issued in Korean Application No. 10-2017-7022820.
Nov. 7, 2017 Office Action issued in U.S. Appl. No. 14/906,131.
Apr. 16, 2018 Office Action issued in U.S. Appl. No. 14/906,131.
May 3, 2019 Office Action issued in U.S. Appl. No. 15/518,190.

* cited by examiner

STEEL SHEET FOR CROWN CAP, METHOD FOR MANUFACTURING STEEL SHEET FOR CROWN CAP, AND CROWN CAP

TECHNICAL FIELD

The present disclosure relates to a steel sheet for crown cap used as a cap for glass bottles, a method for manufacturing the same, and a crown cap.

BACKGROUND ART

Many glass bottles have conventionally been used as containers for drinks such as soft drinks and alcohols. Metal caps called crown caps are widely used for narrow-mouthed glass bottles. In general, a crown cap is manufactured from a steel sheet by press forming and includes a disk-shaped portion for covering the mouth of a bottle and a pleated portion placed therearound. The bottle is tightly sealed by crimping the pleated portion to the mouth of the bottle.

Contents, such as beer and carbonated drinks, causing an internal pressure are often filled in bottles for which crown caps are used. Therefore, the crown caps need to have high pressure resistance such that the seal of the bottles is not broken by the deformation of the crown caps when the internal pressure is increased by a change in temperature or the like. Furthermore, even if the strength of the material is sufficient, when the material has poor formability, the shape of pleats becomes non-uniform; hence, even if a pleated portion is crimped to the mouth of a bottle, sufficient airtightness can not be obtained in some cases. Therefore, the crown caps need to have excellent formability.

A steel sheet used to manufacture crown caps is mainly an SR (single-reduced) steel sheet. This is obtained in such a manner that a steel plate is thinned by cold rolling, is annealed, and is then temper rolled. The thickness of a steel sheet for conventional crown caps is generally 0.22 mm or more and sufficient pressure resistance and formability have been capable of being ensured by the use of an SR material made of mild steel used to for cans for foods and drinks.

In recent years, a reduction in the thickness has been increasingly required for steel sheets for crown caps, as well as steel sheets for cans, for the purpose of cost reduction. When the thickness of a steel sheet for crown caps is 0.20 mm or less, a crown cap manufactured from a conventional SR material is short of pressure resistance. In order to ensure the pressure resistance, it is conceivable to use a DR (double-reduced) steel sheet which is obtained by performing secondary cold rolling after annealing and which can take advantage of work hardening compensating for a reduction in strength due to the reduction of the thickness. An increase in rolling reduction during secondary cold rolling hardens a steel sheet to reduce the formability thereof. In the formation of a crown cap, a central portion is drawn to a certain degree early in the formation thereof and an outside edge portion is then formed into a pleated shape. In the case of a steel sheet with low formability, a shape failure in which the pleated shape is non-uniform occurs in some cases. A crown cap with a non-uniform pleated shape has a problem that pressure resistance can not be obtained by capping a bottle, contents leak, and the crown cap does not play a role as a lid. When the strength of a steel sheet is low, a crown cap may possibly be detached due to insufficient pressure resistance even if the pleated shape thereof is uniform.

In order to obtain a steel sheet having both excellent strength and formability in the reduction of thickness, techniques below have been proposed.

Patent Literature 1 discloses a soft steel sheet, excellent in can strength and can formability, for containers. The soft steel sheet contains N: 0.0040% to 0.0300% and Al: 0.005% to 0.080% on a mass basis and has a 0.2% yield strength of 430 MPa or less as determined by a tensile test using a JIS No. 5 test specimen, a total elongation of 15% to 40%, a $Q^{-1}$ of 0.0010 or more due to internal friction, and a thickness of 0.4 mm or less.

Patent Literature 2 discloses a high-strength, high-workability steel sheet for cans. The steel sheet contains C: 0.001% to 0.080%, Si: 0.003% to 0.100%, Mn: 0.10% to 0.80%, P: 0.001% to 0.100%, S: 0.001% to 0.020%, Al: 0.005% to 0.100%, N: 0.0050% to 0.0150%, and B: 0.0002% to 0.0050% on a mass basis and also contains crystal grains having an elongation rate of 5.0 or more in a rolling-direction cross section at an area fraction of 0.01% to 1.00%.

CITATION LIST

Patent Literature

PTL 1: Japanese Unexamined Patent Application Publication No. 2001-49383

PTL 2: Japanese Unexamined Patent Application Publication No. 2013-28842

SUMMARY

Technical Problem

However, when the above techniques are applied to the reduction in thickness of steel sheets for crown caps, the techniques have problems that the performance of crown caps cannot be ensured. The steel sheet described in Patent Literature 1 is soft, contains a large amount of N, and therefore has increased anisotropy and reduced formability in the case of increasing the secondary cold rolling reduction for the purpose of obtaining a necessary strength. Likewise, the steel sheet described in Patent Literature 2 has a high N content and therefore it is difficult to achieve the pressure resistance and formability required for crown caps.

The present disclosure has been made in view of the above problems. It is an object of the present disclosure to provide a steel sheet, having sufficient strength and formability even when the thickness of the steel sheet is reduced, for crown caps; a method for manufacturing the same; and a crown cap.

Solution to Problem

[1] A steel sheet for crown caps has a composition containing C: 0.0010% to less than 0.0050%, Si: 0.10% or less, Mn: 0.05% to less than 0.50%, P: 0.050% or less, S: 0.050% or less, Al: more than 0.002% to less than 0.070%, N: less than 0.0040%, and B: 0.0005% to 0.0020% on a mass basis, the balance being Fe and inevitable impurities, and also has a yield strength of 500 MPa or more in a rolling direction, an average Lankford value (r) of 1.1 or more as given by the following equation (1), and an in-plane anisotropy (Δr) of Lankford value of −0.3 to 0.3 as given by the following equation (3):

$$r=101.44/(145.0\times E\times 10^{-6}-38.83)^2-0.564 \quad (1)$$

$$\text{where } E=(E_0+2E_{45}+E_{90})/4 \quad (2)$$

where $E_0$, $E_{45}$, and $E_{90}$ are the Young's modulus (MPa) in a 0° direction, the Young's modulus (MPa) in a 45° direction, and the Young's modulus (MPa) in a 90° direction, with respect to the rolling direction, respectively, $$\Delta r=0.031-4.685\times10^{-5}\times\Delta E \quad (3)$$

$$\text{where } \Delta E=(E_0-2E_{45}+E_{90})/2 \quad (4).$$

[2] The steel sheet for crown caps specified in Item [1], having a thickness of 0.20 mm or less.

[3] A method for manufacturing a steel sheet for crown caps, comprising hot rolling a steel slab having the composition specified in Item [1], performing cooling at a cooling rate of 30° C./s to 80° C./s after finish rolling, performing coiling at a temperature of 570° C. to 670° C., performing primary cold rolling, performing annealing at a temperature of 620° C. to 720° C., and performing secondary cold rolling at a rolling reduction of more than 20% to 50%.

[4] A crown cap formed from the steel sheet for crown caps according to Item [1] or [2].

Advantageous Effects

The present disclosure can provide a steel sheet, having sufficient strength and formability even when the thickness of the steel sheet is reduced, for crown caps; a method for manufacturing the same; and a crown cap.

DESCRIPTION OF EMBODIMENTS

A steel sheet for crown caps according to the present disclosure has a composition containing C: 0.0010% to less than 0.0050%, Si: 0.10% or less, Mn: 0.05% to less than 0.50%, P: 0.050% or less, S: 0.050% or less, Al: more than 0.002% to less than 0.070%, N: less than 0.0040%, and B: 0.0005% to 0.0020% on a mass basis, the balance being Fe and inevitable impurities, and also has a yield strength of 500 MPa or more in a rolling direction, an average Lankford value ($r(=101.44/(145.0\times E\times10^{-6}-38.83)^2-0.564)$ of 1.1 or more, and an in-plane anisotropy ($\Delta r(=0.031-4.685\times10^{-5}\times\Delta E)$) of Lankford value of −0.3 to 0.3.

First, the composition of the steel sheet for crown caps according to exemplary disclosed embodiments is described. The unit "%" of the content is "mass percent".

Content of C: 0.0010% to Less Than 0.0050%

Even if the content of C is reduced to less than 0.0010%, no particular effect is obtained and refining costs are excessive. On the other hand, containing a large amount of C reduces the average Lankford value (r) and impairs the formability of a crown cap as described later. In particular, when the content of C is 0.0050% or more, the shape of pleats of the formed crown cap is non-uniform, leading to shape failures. Thus, the content of C is set to 0.0010% to less than 0.0050%.

Content of Si: 0.10% or Less

Containing a large amount of Si impairs the formability of the crown cap because of the same reason as C. Thus, the content of Si is set to 0.10% or less. From the viewpoint of increasing the strength of the steel sheet, the content of Si is preferably set to 0.01% or more.

Content of Mn: 0.05% to Less Than 0.50%

When the content of Mn is below 0.05%, it is difficult to avoid hot brittleness even in the case of reducing the content of S and a problem such as surface cracking occurs during continuous casting. Thus, the content of Mn is set to 0.05% or more. However, containing a large amount of Mn impairs the formability of the crown cap because of the same reason as C. Thus, the content of Mn is set to less than 0.50%.

Content of P: 0.050% or Less

When the content of P is more than 0.050%, the hardening of the steel sheet and the reduction in corrosion resistance thereof are caused. Thus, the upper limit of the content of P is set to 0.050%. In order to adjust the content of P to less than 0.001%, dephosphorization costs are excessive. Therefore, the content of P is preferably set to 0.001% or more.

Content of S: 0.050% or Less

S combines with Mn in the steel sheet to form MnS, which precipitates in a large amount, thereby reducing the hot ductility of the steel sheet. When the content of S is more than 0.050%, this influence is significant. Thus, the upper limit of the content of S is set to 0.050%. In order to adjust the content of S to less than 0.005%, desulfurization costs are excessive. Therefore, the content of S is preferably set to 0.005% or more.

Content of Al: More Than 0.002% to Less Than 0.070%

Al is an element contained as a deoxidizer and forms AlN together with N in steel to reduce the amount of solute N in steel. When the content of Al is 0.002% or less, the effect of the deoxidizer is insufficient and casting defects occur. On the other hand, when the rolling reduction during secondary cold rolling is high, a large amount of Al causes a reduction in formability. In particular, when the content of Al is 0.070% or more, the average Lankford value (r) is low and the formability of the crown cap is impaired. Thus, the content of Al is set to more than 0.002% to less than 0.070%.

Content of N: Less Than 0.0040%

When the content of N is 0.0040% or more, the average Lankford value (r) is low and the formability of the crown cap is impaired. Thus, the content of N is set to less than 0.0040%. Stably adjusting the content of N to less than 0.0010% is difficult and causes excessive manufacturing costs. Therefore, the content of N is preferably set to 0.0010% or more.

Content of B: 0.0005% to 0.0020%

Containing B enables the formation of coarse grains after hot rolling to be suppressed. Therefore, B is an element necessary to increase the strength of the steel sheet according to the present disclosure. When the content of B is less than 0.0005%, the above effect is not sufficiently exhibited. However, even if the content of B exceeds 0.0020%, no further effect can be expected and an increase in cost is caused. Thus, the content of B is set to 0.0005% to 0.0020%. The content of B is preferably 0.0008% to 0.0015%.

The balance are Fe and inevitable impurities.

Mechanical properties of the steel sheet for crown caps according to the present disclosure are described below.

The steel sheet for crown caps according to the present disclosure is required to have such a pressure resistance that the crown cap is not detached by the internal pressure in a bottle. The thickness of a conventionally used steel sheet for crown caps was 0.22 mm or more. In the reduction of thickness in which the thickness of a sheet is 0.20 mm or less, strength higher than ever is necessary. If the yield strength of the steel sheet in the rolling direction is less than 500 MPa, then sufficient pressure resistance cannot be imparted to a thinned crown cap as described above. Thus, the yield strength in the rolling direction is set to 500 MPa or more. Incidentally, the yield strength can be measured by a metallic material tensile test method specified in "JIS Z 2241". A desired yield strength can be obtained in such a manner that the composition is adjusted, the cooling rate after hot rolling finishing is adjusted, and the rolling reduction in a secondary cold rolling step is adjusted. A yield strength of 500 MPa or more can be obtained in such a manner that the above-mentioned composition is set, the cooling rate after hot rolling finishing is adjusted to 30° C./s or more, and the rolling reduction in the secondary cold rolling step is adjusted to more than 20%.

The steel sheet for crown caps is punched into a circular blank, which is then formed into a crown cap by press forming. The shape of the formed crown cap is mainly evaluated in terms of the uniformity of the shape of pleats. When the shape of the pleats is non-uniform, the airtightness after capping is impaired in some cases, leading to the leakage of contents in a bottle. The formability of the steel sheet for crown caps closely correlates with the average Lankford value (r) and the in-plane anisotropy (Δr) of Lankford value. When the average Lankford value (r) is less than 1.1 or the in-plane anisotropy (Δr) of Lankford value is less than −0.3 or more than 0.3, the shape of the pleats after forming is non-uniform. Thus, the average Lankford value (r) is set to 1.1 or more and the in-plane anisotropy (Δr) of Lankford value is set to −0.3 to 0.3. The average Lankford value (r) is more preferably 1.2 or more.

The average Lankford value (r) can be evaluated by a method specified in Appendix JA of "JIS Z 2254" and is given by Equation (1) below. The average Lankford value (r) can be determined from the average Young's modulus (E) given by Equation (2) below in such a manner that the Young's modulus is measured in each direction by a method specified in Appendix JA of "JIS Z 2254". The in-plane anisotropy (Δr) of Lankford value is given by Equation (3) below as described in Non-patent Literature 1 (P. R. Mould and T. E. Johnson Jr, "Rapid assessment of cold-rolled low carbon steel sheets", Sheet metal Industries, Vol. 50, 1973, pp. 328-332). The in-plane anisotropy (Δr) of Lankford value can be determined from the in-plane anisotropy (ΔE) of Young's modulus that is given by Equation (4) below in such a manner that the Young's modulus is measured in each direction by a method specified in Appendix JA of "JIS Z 2254".

$$r=101.44/(145.0\times E\times 10^{-6}-38.83)^2-0.564 \quad (1)$$

$$\text{where } E=(E_0+2E_{45}+E_{90})/4 \quad (2)$$

where $E_0$, $2E_{45}$, and $E_{90}$ are the Young's modulus (MPa) in a 0° direction, the Young's modulus (MPa) in a 45° direction, and the Young's modulus (MPa) in a 90° direction, with respect to the rolling direction, respectively.

$$\Delta r=0.031-4.685\times 10^{-5}\times \Delta E \quad (3)$$

$$\text{where } \Delta E=(E_0-2E_{45}+E_{90})/2 \quad (4)$$

A desired average Lankford value (r) can be obtained in such a manner that the composition is adjusted and the coiling temperature during hot rolling is adjusted. An average Lankford value (r) of 1.1 or more can be obtained in such a manner that above-mentioned composition is set and the coiling temperature during hot rolling is adjusted to 670° C. or lower.

A desired in-plane anisotropy (Δr) of Lankford value can be obtained in such a manner that the cooling rate after hot rolling finishing is adjusted and the annealing temperature and the rolling reduction in the secondary cold rolling step are adjusted. An in-plane anisotropy (Δr) of Lankford value of −0.3 to 0.3 can be obtained in such a manner that the cooling rate after hot rolling finishing is adjusted to 80° C./s or lower, the annealing temperature is adjusted to 620° C. or higher, and the rolling reduction in the secondary cold rolling step is adjusted to 50% or less.

An example of a method for manufacturing the steel sheet for crown caps according to the present disclosure is described below. The steel sheet for crown caps according to the present disclosure is manufactured in such a manner that a steel slab having the above-mentioned composition is hot-rolled, cooling is performed at a cooling rate of 30° C./s to 80° C./s after finish rolling, coiling is performed at a temperature of 570° C. to 670° C., primary cold rolling is performed, annealing is performed at a temperature of 620° C. to 720° C., and secondary cold rolling is performed at a rolling reduction of more than 20% to 50%.

Upon manufacturing the steel sheet for crown caps according to the present disclosure, molten steel is prepared by a known process using a converter or the like so as to contain the above-mentioned chemical components and is then cast into a slab by, for example, a continuous casting process. Subsequently, the slab is preferably roughly rolled in a high heating temperature. A rough rolling process is not particularly limited and the heating temperature of the slab is preferably 1,200° C. or higher.

The finish rolling temperature in a hot rolling step is preferably 850° C. or higher from the viewpoint of the stability of rolling load. However, unnecessarily raising the finish rolling temperature makes it difficult to manufacture a thin steel sheet in some cases. In particular, the finish rolling temperature preferably ranges from 850° C. to 960° C.

It is not preferable that the cooling rate after finish rolling in the hot rolling step is reduced to lower than 30° C./s, because ferrite grows excessively during cooling and the yield strength of the steel sheet after secondary cold rolling in the rolling direction is less than 500 MPa or less. However, when the cooling rate after finish rolling is higher than 80° C./s, the in-plane anisotropy (Δr) of Lankford value is less than −0.3, the anisotropy is excessive, and the formability is impaired. Thus, the cooling rate after finish rolling in the hot rolling step is preferably set to 30° C./s to 80° C./s. The cooling rate is more preferably 30° C./s to 55° C./s. Cooling is preferably started within 4.5 seconds after finish rolling and more preferably within 3.0 seconds. Incidentally, the cooling rate after finish rolling refers to the average cooling rate from the start of cooling to coiling.

It is not preferable that the coiling temperature in the hot rolling step is reduced to lower than 570° C., because the finish rolling temperature needs to be reduced for the purpose of performing stable operation without impairing efficiency. However, when the coiling temperature is higher than 670° C., the amount of AlN that precipitates after coiling is excessive, leading to a decrease in grain size after annealing and the reduction of the average Lankford value (r). Thus, the coiling temperature in the hot rolling step is preferably 570° C. to 670° C. and more preferably 600° C. to 650° C. Subsequently, pickling is performed as required. Pickling may be capable of removing surface scales and conditions for pickling need not be particularly limited. Alternatively, a process such as mechanical removal may be used instead of pickling.

The rolling reduction in a primary cold rolling step is not particularly limited and is preferably 85% to 94% for the purpose of adjusting the thickness of the steel sheet after secondary cold rolling to 0.20 mm or less.

An annealing (heat treatment) step is performed at a temperature of 620° C. to 720° C. It is not preferable that the annealing temperature is increased to higher than 720° C., because processing troubles such as heat buckling are likely to occur during continuous annealing. When the annealing temperature is lower than 620° C., recrystallization is incomplete and quality is non-uniform. Thus, the annealing (heat treatment) step is preferably performed at a temperature of 620° C. to 720° C. and more preferably 650° C. to 720° C.

The steel sheet for crown caps according to the present disclosure can obtain a necessary yield strength by secondary cold rolling after annealing. When the rolling reduction during secondary cold rolling is 20% or less, a yield strength sufficient to ensure the pressure resistance the crown cap cannot be obtained. When the rolling reduction during secondary cold rolling is more than 50%, the anisotropy is excessive and the formability is impaired. Thus, the rolling reduction during secondary cold rolling is preferably more than 20% to 50%. The rolling reduction during secondary cold rolling is more preferably more than 20% to 40%.

A cold-rolled steel sheet obtained as described above is then subjected to a plating treatment such as tin plating, chromium plating, or nickel plating by, for example, electroplating as required such that a plated layer is formed on a surface of the steel sheet, whereby the steel sheet for crown caps is obtained. The thickness of a surface treated layer such as plating is sufficiently less than the thickness of the steel sheet and therefore the influence on mechanical properties of the steel sheet for crown caps is a negligible level.

As described above, the steel sheet for crown caps according to the present disclosure is capable of having sufficient strength and formability regardless of the reduction of thickness.

A crown cap according to the present disclosure is formed using the above-mentioned steel sheet for crown caps. The crown cap is mainly composed of a disk-shaped portion for covering the mouth of a bottle and a pleated portion placed therearound. The crown cap according to the present disclosure can be formed in such a manner that a circular blank is punched, followed by press forming. The crown cap according to the present disclosure is manufactured from a steel sheet having sufficient yield strength and excellent formability, therefore is excellent in pressure resistance as a crown cap regardless of the reduction of thickness, and has the effect of reducing the emission of wastes in association with use.

EXAMPLES

In these examples, each steel containing components shown in Table 1, the balance being Fe and inevitable impurities, was produced in a converter and was continuously cast, whereby a steel slab was obtained. The obtained steel slab was reheated to 1,250° C. and was then hot-rolled at a rolling start temperature of 1,150° C., followed by coiling at a finish rolling temperature, cooling rate, and coiling temperature shown in Table 2. Pickling was performed after hot rolling. Next, primary cold rolling was performed at a rolling reduction shown in Table 2 and continuous annealing was performed at an annealing temperature shown in Table 2. Subsequently, secondary cold rolling was performed at a rolling reduction shown in Table 2. An obtained steel sheet was continuously subjected to usual Cr plating, whereby tin-free steel was obtained.

TABLE 1

(Mass percent)

| | C | Si | Mn | P | S | Al | N | B |
|---|---|---|---|---|---|---|---|---|
| Level 1 | 0.0022 | 0.02 | 0.35 | 0.010 | 0.016 | 0.038 | 0.0025 | 0.0012 |
| Level 2 | 0.0047 | 0.01 | 0.30 | 0.015 | 0.019 | 0.052 | 0.0019 | 0.0010 |
| Level 3 | 0.0024 | 0.05 | 0.31 | 0.020 | 0.015 | 0.041 | 0.0022 | 0.0013 |
| Level 4 | 0.0025 | 0.02 | 0.17 | 0.015 | 0.014 | 0.040 | 0.0022 | 0.0012 |
| Level 5 | 0.0018 | 0.03 | 0.48 | 0.011 | 0.016 | 0.059 | 0.0028 | 0.0012 |
| Level 6 | 0.0020 | 0.01 | 0.38 | 0.044 | 0.020 | 0.050 | 0.0012 | 0.0015 |
| Level 7 | 0.0014 | 0.02 | 0.31 | 0.018 | 0.046 | 0.035 | 0.0023 | 0.0011 |
| Level 8 | 0.0018 | 0.02 | 0.33 | 0.020 | 0.018 | 0.020 | 0.0027 | 0.0013 |
| Level 9 | 0.0022 | 0.03 | 0.35 | 0.015 | 0.012 | 0.067 | 0.0020 | 0.0010 |
| Level 10 | 0.0023 | 0.01 | 0.32 | 0.019 | 0.015 | 0.051 | 0.0038 | 0.0014 |
| Level 11 | 0.0019 | 0.02 | 0.30 | 0.012 | 0.013 | 0.047 | 0.0030 | 0.0020 |
| Level 12 | 0.0063 | 0.01 | 0.34 | 0.018 | 0.016 | 0.040 | 0.0025 | 0.0012 |
| Level 13 | 0.0022 | 0.01 | 0.58 | 0.013 | 0.014 | 0.055 | 0.0024 | 0.0013 |
| Level 14 | 0.0020 | 0.03 | 0.35 | 0.016 | 0.018 | 0.074 | 0.0018 | 0.0013 |
| Level 15 | 0.0023 | 0.02 | 0.38 | 0.020 | 0.017 | 0.061 | 0.0042 | 0.0014 |
| Level 16 | 0.0017 | 0.02 | 0.32 | 0.014 | 0.013 | 0.039 | 0.0028 | 0.0003 |
| Level 17 | 0.0022 | 0.01 | 0.33 | 0.009 | 0.015 | 0.042 | 0.0025 | 0.0015 |
| Level 18 | 0.0025 | 0.02 | 0.39 | 0.013 | 0.017 | 0.053 | 0.0020 | 0.0011 |
| Level 19 | 0.0018 | 0.01 | 0.34 | 0.015 | 0.016 | 0.039 | 0.0022 | 0.0012 |
| Level 20 | 0.0023 | 0.02 | 0.31 | 0.010 | 0.012 | 0.058 | 0.0023 | 0.0010 |
| Level 21 | 0.0021 | 0.01 | 0.29 | 0.011 | 0.018 | 0.037 | 0.0031 | 0.0011 |
| Level 22 | 0.0025 | 0.02 | 0.36 | 0.012 | 0.015 | 0.040 | 0.0027 | 0.0012 |
| Level 23 | 0.0023 | 0.02 | 0.33 | 0.010 | 0.017 | 0.038 | 0.0024 | 0.0010 |
| Level 24 | 0.0029 | 0.01 | 0.37 | 0.011 | 0.016 | 0.032 | 0.0026 | 0.0013 |
| Level 25 | 0.0027 | 0.02 | 0.33 | 0.010 | 0.019 | 0.036 | 0.0029 | 0.0012 |

TABLE 2

| | Hot-rolling finish temperature (° C.) | Cooling rate (° C./s) | Hot-rolling coiling temperature (° C.) | Thickness of hot-rolled sheet (mm) | Primary cold-rolling reduction (%) | Annealing temperature (° C.) | Secondary cold-rolling reduction (%) | Thickness of finished sheet (mm) | Remarks |
|---|---|---|---|---|---|---|---|---|---|
| Level 1 | 910 | 35 | 630 | 2.5 | 90 | 650 | 30 | 0.18 | Inventive example |
| Level 2 | 950 | 50 | 660 | 2.5 | 90 | 680 | 35 | 0.16 | Inventive example |
| Level 3 | 935 | 45 | 600 | 2.5 | 90 | 700 | 30 | 0.18 | Inventive example |
| Level 4 | 860 | 60 | 580 | 2.5 | 88 | 660 | 40 | 0.18 | Inventive example |
| Level 5 | 880 | 55 | 620 | 2.5 | 90 | 630 | 30 | 0.18 | Inventive example |
| Level 6 | 940 | 50 | 640 | 2.5 | 90 | 650 | 30 | 0.18 | Inventive example |
| Level 7 | 855 | 30 | 670 | 2.5 | 90 | 720 | 25 | 0.19 | Inventive example |
| Level 8 | 900 | 55 | 610 | 3.0 | 90 | 630 | 50 | 0.15 | Inventive example |
| Level 9 | 870 | 50 | 590 | 2.5 | 90 | 670 | 30 | 0.18 | Inventive example |
| Level 10 | 890 | 40 | 630 | 2.5 | 88 | 710 | 35 | 0.20 | Inventive example |
| Level 11 | 945 | 75 | 570 | 2.5 | 88 | 620 | 40 | 0.18 | Inventive example |
| Level 12 | 875 | 60 | 650 | 3.0 | 88 | 650 | 45 | 0.20 | Comparative example |
| Level 13 | 920 | 30 | 620 | 2.5 | 90 | 680 | 25 | 0.19 | Comparative example |
| Level 14 | 905 | 55 | 630 | 2.5 | 90 | 690 | 30 | 0.18 | Comparative example |
| Level 15 | 910 | 65 | 610 | 2.5 | 88 | 640 | 40 | 0.18 | Comparative example |
| Level 16 | 930 | 50 | 650 | 3.0 | 88 | 700 | 45 | 0.20 | Comparative example |
| Level 17 | 900 | 40 | 680 | 2.5 | 90 | 630 | 30 | 0.18 | Comparative example |
| Level 18 | 895 | 30 | 590 | 2.5 | 90 | 610 | 25 | 0.19 | Comparative example |
| Level 19 | 910 | 35 | 660 | 2.5 | 90 | 670 | 20 | 0.20 | Comparative example |
| Level 20 | 865 | 70 | 630 | 3.0 | 88 | 650 | 55 | 0.16 | Comparative example |
| Level 21 | 905 | 15 | 640 | 2.5 | 90 | 660 | 30 | 0.18 | Comparative example |
| Level 22 | 900 | 25 | 650 | 2.3 | 89 | 650 | 35 | 0.16 | Comparative example |
| Level 23 | 910 | 85 | 610 | 2.5 | 90 | 640 | 35 | 0.16 | Comparative example |
| Level 24 | 890 | 95 | 630 | 2.5 | 89 | 680 | 30 | 0.19 | Comparative example |
| Level 25 | 875 | 10 | 650 | 2.5 | 90 | 710 | 30 | 0.18 | Comparative example |

The steel sheet obtained as described above was subjected to a heat treatment corresponding to lacquer baking at 120° C. for 15 minutes, followed by tensile testing, the measurement of the average Lankford value r, and the measurement of the in-plane anisotropy Δr of Lankford value. Tensile testing was performed using a tensile test specimen with a JIS #5 size in accordance with "JIS Z 2241", whereby the yield strength in a rolling direction was measured. The average Lankford value (r) given by Equation (1) below was measured by a natural vibration method specified in Appendix JA of "JIS Z 2254". The in-plane anisotropy (Δr) of the Lankford value given by Equation (2) below was calculated from the Young's modulus determined in each direction by the natural vibration method specified in Appendix JA of "JIS Z 2254" using Equation (3) below.

$$r=101.44/(145.0\times E\times 10^{-6}-38.83)^2-0.564 \quad (1)$$

$$\text{where } E=(E_0+2E_{45}+E_{90})/4 \quad (2)$$

where $E_0$, $2E_{45}$, and $E_{90}$ are the Young's modulus (MPa) in a 0° direction, the Young's modulus (MPa) in a 45° direction, and the Young's modulus (MPa) in a 90° direction, with respect to the rolling direction, respectively.

$$\Delta r=0.031-4.685\times 10^{-5}\times \Delta E \quad (3)$$

$$\text{where } \Delta E=(E_0-2E_{45}+E_{90})/2 \quad (4)$$

The obtained steel sheet was formed into a crown cap and was evaluated for crown cap formability. A circular blank with a diameter of 37 mm was formed to have dimensions (an outside diameter of 32.1 mm, a height of 6.5 mm, the number of pleats being 21) of a type-3 crown cap specified in "JIS S 9017" (abolished standard) by press forming. Evaluation was performed by visual check. The case where the size of all pleats was uniform was rated A. The case where the size of pleats was non-uniform was rated B.

A pressure test was performed using the formed crown cap. In the pressure test, a polyvinyl chloride liner was formed inside the crown cap, a commercially available beer bottle was capped with the crown cap, and the internal pressure at which the crown cap was detached was measured using Secure Seal Tester manufactured by Secure Pak. The case where a pressure resistance higher than or equal to that of a conventional crown cap was exhibited was rated A. The case where the pressure resistance of the conventional crown cap was not exhibited was rated B. Obtained results are shown in Table 3.

TABLE 3

| | Yield strength in rolling-direction (MPa) | $E_0$ (MPa) | $E_{45}$ (MPa) | $E_{90}$ (MPa) | E (MPa) | E (MPa) | Average Lankford value (r) |
|---|---|---|---|---|---|---|---|
| Level 1 | 528 | 212574 | 214633 | 221814 | 215914 | 215914 | 1.2 |
| Level 2 | 546 | 215598 | 212745 | 224215 | 216326 | 216326 | 1.3 |
| Level 3 | 532 | 212197 | 214254 | 221443 | 215537 | 215537 | 1.2 |
| Level 4 | 563 | 213149 | 213052 | 222759 | 215503 | 215503 | 1.2 |
| Level 5 | 530 | 212839 | 214520 | 221271 | 215788 | 215788 | 1.2 |
| Level 6 | 534 | 213110 | 213546 | 221149 | 215338 | 215338 | 1.2 |
| Level 7 | 506 | 213911 | 213731 | 223902 | 216319 | 216319 | 1.3 |
| Level 8 | 581 | 213364 | 210272 | 222946 | 214214 | 214214 | 1.1 |
| Level 9 | 528 | 213100 | 213516 | 221424 | 215389 | 215389 | 1.2 |
| Level 10 | 550 | 214563 | 214333 | 226327 | 217389 | 217389 | 1.3 |

TABLE 3-continued

| | | | | | | | |
|---|---|---|---|---|---|---|---|
| Level 11 | 562 | 213431 | 212917 | 222338 | 215401 | 215401 | 1.2 |
| Level 12 | 582 | 212162 | 210235 | 219431 | 213016 | 213016 | 1.0 |
| Level 13 | 510 | 211336 | 210197 | 219681 | 212853 | 212853 | 1.0 |
| Level 14 | 535 | 206869 | 208164 | 215475 | 209668 | 209668 | 0.9 |
| Level 15 | 568 | 211241 | 210032 | 219331 | 212809 | 212809 | 1.0 |
| Level 16 | 497 | 213397 | 213534 | 222058 | 215631 | 215631 | 1.2 |
| Level 17 | 530 | 207960 | 208340 | 215263 | 209976 | 209976 | 0.9 |
| Level 18 | 503 | 214212 | 212643 | 228113 | 216903 | 216903 | 1.3 |
| Level 19 | 482 | 214524 | 214667 | 222007 | 216466 | 216466 | 1.3 |
| Level 20 | 592 | 213671 | 207334 | 225184 | 213381 | 213381 | 1.1 |
| Level 21 | 469 | 212145 | 212172 | 218365 | 213714 | 213714 | 1.1 |
| Level 22 | 477 | 215309 | 211135 | 217930 | 213877 | 213877 | 1.1 |
| Level 23 | 552 | 213494 | 208000 | 225472 | 213742 | 213742 | 1.1 |
| Level 24 | 531 | 214655 | 207946 | 224906 | 213863 | 213863 | 1.1 |
| Level 25 | 474 | 216486 | 211417 | 214219 | 213385 | 213385 | 1.1 |

| | ΔE (MPa) | In-plane anisotropy of Lankford value (Δr) | Crown cap formability | Pressure resistance | Remarks |
|---|---|---|---|---|---|
| Level 1 | 2561 | −0.1 | A | A | Inventive example |
| Level 2 | 7162 | −0.3 | A | A | Inventive example |
| Level 3 | 2566 | −0.1 | A | A | Inventive example |
| Level 4 | 4902 | −0.2 | A | A | Inventive example |
| Level 5 | 2535 | −0.1 | A | A | Inventive example |
| Level 6 | 3584 | −0.1 | A | A | Inventive example |
| Level 7 | 5176 | −0.2 | A | A | Inventive example |
| Level 8 | 7883 | −0.3 | A | A | Inventive example |
| Level 9 | 3746 | −0.1 | A | A | Inventive example |
| Level 10 | 6112 | −0.3 | A | A | Inventive example |
| Level 11 | 4968 | −0.2 | A | A | Inventive example |
| Level 12 | 5562 | −0.2 | B | B | Comparative example |
| Level 13 | 5312 | −0.2 | B | B | Comparative example |
| Level 14 | 3008 | −0.1 | B | B | Comparative example |
| Level 15 | 5554 | −0.2 | B | B | Comparative example |
| Level 16 | 4194 | −0.2 | A | B | Comparative example |
| Level 17 | 3272 | −0.1 | B | B | Comparative example |
| Level 18 | 8520 | −0.4 | B | B | Comparative example |
| Level 19 | 3599 | −0.1 | A | B | Comparative example |
| Level 20 | 12094 | −0.5 | B | B | Comparative example |
| Level 21 | 3083 | −0.1 | A | B | Comparative example |
| Level 22 | 5485 | −0.2 | A | B | Comparative example |
| Level 23 | 11483 | −0.5 | B | B | Comparative example |
| Level 24 | 11835 | −0.5 | B | B | Comparative example |
| Level 25 | 3936 | −0.2 | A | B | Comparative example |

As is clear from Table 3, the steel sheets of Levels 1 to 11 that are inventive examples have a yield strength of 500 MPa in the rolling direction, an average Lankford value of 1.1 or more, and an in-plane anisotropy of Lankford value of −0.3 to 0.3 and are good in both crown cap formability and pressure resistance. However, it has become clear that the steel sheet of Level 12 that is a comparative example has an average Lankford value of less than 1.1, poor crown cap formability, and insufficient pressure resistance because the content of C is excessively high. It has become clear that the steel sheet of Level 13 has an average Lankford value of less than 1.1, poor crown cap formability, and insufficient pressure resistance because the content of Mn is excessively high. It has become clear that the steel sheet of Level 14 has an average Lankford value of less than 1.1, poor crown cap formability, and insufficient pressure resistance because the content of Al is excessively high. It has become clear that the steel sheet of Level 15 has an average Lankford value of less than 1.1, poor crown cap formability, and insufficient pressure resistance because the content of N is excessively high. It has become clear that the steel sheet of Level 17 has an average Lankford value of less than 1.1, poor crown cap formability, and insufficient pressure resistance because the coiling temperature after hot rolling is excessively high.

It has become clear that the steel sheet of Level 16 that is a comparative example has a yield strength of less than 500 MPa in the rolling direction and insufficient pressure resistance because the content of B is excessively low. It has become clear that the steel sheet of Level 19 has a yield strength of less than 500 MPa in the rolling direction and insufficient pressure resistance because the secondary cold rolling reduction is excessively small. It has become clear that the steel sheets of Levels 21, 22, and 25 have a yield strength of less than 500 MPa in the rolling direction and insufficient pressure resistance because the cooling rate after finish rolling in a hot rolling step is excessively low.

It has become clear that the steel sheet of Level 18 that is a comparative example has a negatively excessive in-plane anisotropy of Lankford value, poor crown cap formability, and insufficient pressure resistance because the annealing temperature is excessively low. It has become clear that the steel sheet of Level 20 that is a comparative example has a negatively excessive in-plane anisotropy of Lankford value, poor crown cap formability, and insufficient pressure resistance because the secondary cold rolling reduction is excessively large. It has become clear that the steel sheets of Levels 23 and 24 have a negatively excessive in-plane anisotropy of Lankford value, poor crown cap formability, and insufficient pressure resistance because the cooling rate in the hot rolling step is excessively high.

The invention claimed is:

1. A steel sheet for a crown cap, the steel sheet having a composition comprising:

C: 0.0010% to less than 0.0050%, by mass %;

Si: 0.10% or less, by mass %;

Mn: 0.05% to less than 0.50%, by mass %;

P: 0.050% or less, by mass %;

S: 0.050% or less, by mass %;

Al: 0.020% to less than 0.070%, by mass %;

N: less than 0.0040%, by mass %;

B: 0.0005% to 0.0020%, by mass %; and

Fe and inevitable impurities, wherein:

the steel sheet has a yield strength of 500 MPa or more in a rolling direction, the steel sheet has an average Lankford value (r) of 1.1 or more as given by the following equation (1), and the steel sheet has an in-plane anisotropy (Δr) of Lankford value of −0.3 to 0.3 as given by the following equation (3):

$$r=101.44/(145.0\times E\times 10^{-6}-38.83)^2-0.564 \quad (1)$$

$$\text{where } E=(E_0+2E_{45}+E_{90})/4 \quad (2)$$

where $E_0$, $E_{45}$, and $E_{90}$ are the Young's modulus (MPa) in a 0° direction, the Young's modulus (MPa) in a 45° direction, and the Young's modulus (MPa) in a 90° direction, with respect to the rolling direction, respectively, $$\Delta r=0.031-4.685\times 10^{-5}\times \Delta E \quad (3)$$

$$\text{where } \Delta E=(E_0-2E_{45}+E_{90})/2 \quad (4).$$

2. The steel sheet for a crown cap according to claim 1, wherein the steel sheet has a thickness of 0.20 mm or less.

3. A crown cap formed from the steel sheet for a crown cap according to claim 2.

4. A crown cap formed from the steel sheet for a crown cap according to claim 1.

5. The steel sheet for a crown cap according to claim 1, wherein the average Lankford value (r) of the steel sheet is 1.2 or more.

6. The steel sheet for a crown cap according to claim 1, wherein the steel sheet is subjected to a plating treatment.

7. The steel sheet for a crown cap according to claim 1, wherein the composition comprises C: 0.0010% to 0.0025%, by mass %.

8. A method for manufacturing a steel sheet for a crown cap, the method comprising:

hot rolling a steel slab having the composition specified in claim 1 to form a steel sheet, performing finish rolling on the steel sheet, performing cooling of the steel sheet at a cooling rate of 30° C./s to 80° C./s after the finish rolling, performing coiling of the steel sheet at a temperature of 570° C. to 670° C., performing primary cold rolling of the steel sheet, performing annealing of the steel sheet at a temperature of 620° C. to 720° C., and performing secondary cold rolling of the steel sheet at a rolling reduction of more than 20% to 50%.

* * * * *